US006237200B1

(12) United States Patent
Rodier et al.

(10) Patent No.: US 6,237,200 B1
(45) Date of Patent: May 29, 2001

(54) DEVICE FOR CLIPPING A TEXTILE ARTICLE

(76) Inventors: Alain Rodier, 35 Askbury road, London (GB), SE15; Duncan Barclay, Avenue de Grande Bretagne, Monte Carlo (MC)

( * ) Notice: Subject to any disclaimer, the term of this patent is extended or adjusted under 35 U.S.C. 154(b) by 0 days.

(21) Appl. No.: 09/436,340

(22) Filed: Nov. 8, 1999

(51) Int. Cl.[7] ..... A47G 25/48; A44B 21/00

(52) U.S. Cl. ..... 24/545; 24/343

(58) Field of Search ..... 24/501, 511, 545, 24/546, 343, 344, 346, 556, 561, 565, DIG. 22, DIG. 29, 499, 498; 248/339, 340; 223/91, 96

(56) References Cited

U.S. PATENT DOCUMENTS 2,641,811 * 6/1953 Morgan ..... 24/565
3,405,429 * 10/1968 Vazquez ..... 223/96 X
3,691,596 * 9/1972 Ulansey ..... 24/343
3,923,213 * 12/1975 George et al. ..... 24/343 X
4,261,121 * 4/1981 Coon ..... 223/96 X

* cited by examiner

*Primary Examiner*—Robert J. Sandy
(74) *Attorney, Agent, or Firm*—Richard P. Gilly

(57) ABSTRACT

A device useful forclipping a textile article, such as an article of clothing, or more particularly, a pair os socks. This device consists of a first part (2) fitted with a gripping device (4) located at one of its ends, a second part (3) fitted with a gripping device (5) located at one of its ends, and opposite to the first part, a third part (11) connecting the first and second parts, this third part (11) being flexible and elastic. The first part (2) and the second part (3) are mobile in relation to each other so that in the rest position, the gripping part (4) of the first part (2) and the gripping part (5) of the second part (3) engage with each other to achieve a pinching action on the woven or non-woven material, and so that in the active position, they disengage in such a manner as to release the woven or non-woven material. Application for the clipping, for example, of socks while in the wash or being dried.

6 Claims, 1 Drawing Sheet

DEVICE FOR CLIPPING A TEXTILE ARTICLE

FIELD OF THE INVENTION

This invention concerns a device for holding, by a clip action, at least one article in a textile material, and in particular a pair of socks.

BACKGROUND

We know that when socks are washed, this is done together with other garments, and after drying it is difficult to re-assemble them into pairs.

In stores, socks are sold in pairs. They are held together by means of light stitching or by means of plastic ties which penetrate the heel and the toe. In addition, a small card is places on the legs of the socks, this card bearing printed information such as the make and the size of the socks. This small card is also secured to the socks by means of sewing thread or plastic ties. When it is desired to use the socks, it becomes necessary to cut the stitching or the ties, using scissors for example. When doing this, it is easy to cut the socks when cutting the thread, or frequently, when there are no scissors within reach, one pulls upon the socks to break the thread or the ties. This again is liable to damage the socks by tearing them if excessive force is employed.

The problems which arise can be summarised as follows:

When washing the socks, it is desirable that they be held in pairs in order to prevent them from being separated.

During the sale of socks, it is desirable that they be held together in pairs, and one also requires an advertising element which can be removed easily after the purchase.

SUMMARY OF THE INVENTION

The invention therefore aims to provide a device for holding one or more textile articles, this holding action being reversible. The device according to the invention is intended not only to hold two socks together, but can also be used to hold a fabric coupon or another garment. Moreover, the device according to the invention can be used to suspend textile articles and can be used as an advertising medium. In addition. the device according to the invention is resistant during the wash, and more particularly during a machine wash and during drying.

To this end, the invention concerns a clipping device for at least one article in woven or non-woven material, such that it includes;

- a first part fitted with a gripping device located at one of its ends,
- a second part fitted with a gripping device located at one of its ends, and opposite to the first part,
- a third part connecting the first and second parts, this third part being flexible and elastic.

The first part and the second part being mobile in relation to each other due to the s flexibility and elasticity of the third part, so that in the rest position, the gripping part of the first part and the gripping part of the second part are located opposite to each other to achieve a pinching action on the woven or non-woven material, and so that in the active position, the gripping device of the first part and the gripping device of the second part disengage in such a manner as to release the woven or non-woven material.

The article which is clipped is in a woven or non-woven material. As an example, this article can be in a textile material such as wool, cotton, or synthetic fibres such as Nylon®, Rislan®, etc., and can be woven or non-woven, meaning that it can be a veil obtained by the deposition of a suspension of fibres onto a matrix and then dried. It can, for example, be a non-woven veil in fibres of cotton, of cellulose, or any other types of fibre.

According to the invention, the gripping device of the first part includes teeth which are separated by serrations, and the gripping device of the second part also includes teeth which are separated by serrations, the serrations of the first part engaging between the teeth of the second part when the device is in the rest position.

According to one method of implementation of the invention, the device is such that the first part and the second part are circular arcs opposite to each other, so that the general shape of the device is oval, and the third part is also a circular arc, the centre of which is located alongside the gripping parts of the device, in such a manner that pressure exerted upon the first part and the second part at their ends opposite to the said gripping parts, allow the disengagement of the gripping device of the first part and the gripping device of the second part.

It is preferable that the first part and the second part should include serrations at their outer edges at the ends opposite to their gripping devices, allowing the said ends to be brought together manually in order to disengage the gripping device of the first part from the gripping device of the second part.

According to one method of implementation of the invention, the device also includes a plate, secured to the device by any suitable means, this plate being printed upon and bearing information such as the make of the clipped article. As an example, this plate can be a disk in printable polypropylene, secured at its centre onto a tab on the first part. The device according to the invention is also such that it includes, at the end opposite to the gripping part, a hook which enables the device to be placed onto a bar, such as the display racks normally used in department stores.

The device according to the invention is made of a resiliently flexible material, such as a device in a plastic material like polyvinyl chloride.

BRIEF DESCRIPTION OF THE DRAWINGS

The following description, referred to the attached drawings provided by way of non-exhaustive examples, will enable one to understand how the invention can be implemented in practice.

Figure 1:
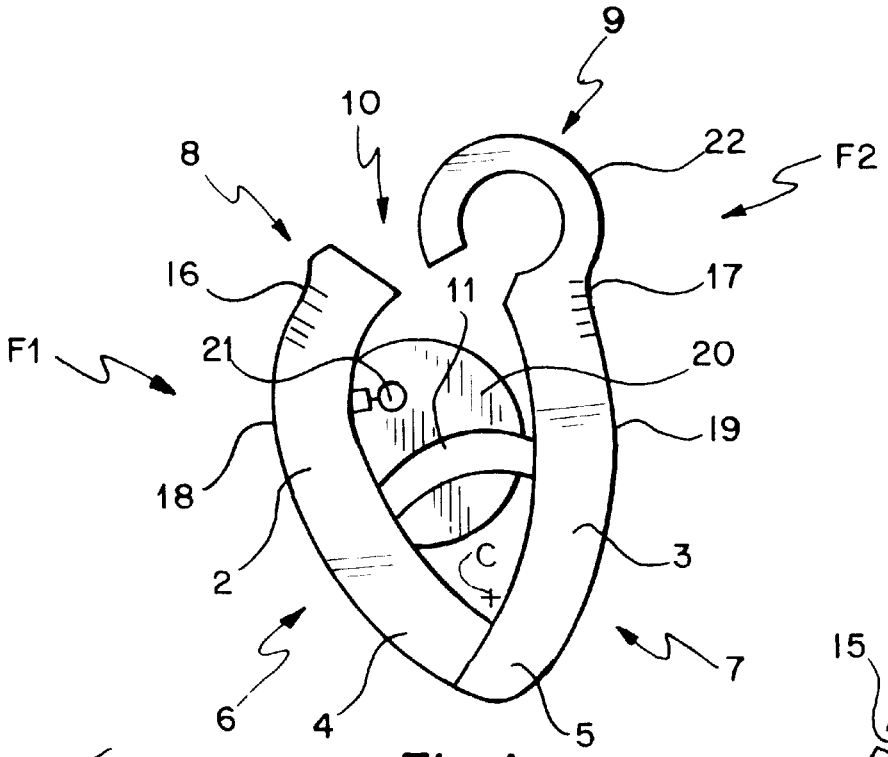
FIG. 1 is a front view of the device according to the invention, in the closed position, with the article in woven or non-woven material held by the device.
Figure 2:
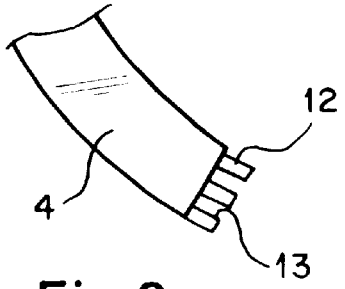
FIG. 2 is a view of the gripping device located at the end of the first part.
Figure 3:
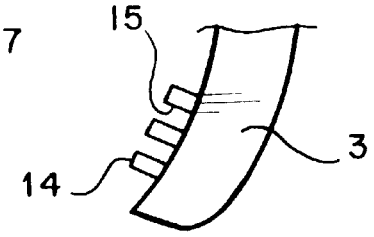
FIG. 3 is a view of the gripping device located at the end of the second part.
Figure 4:
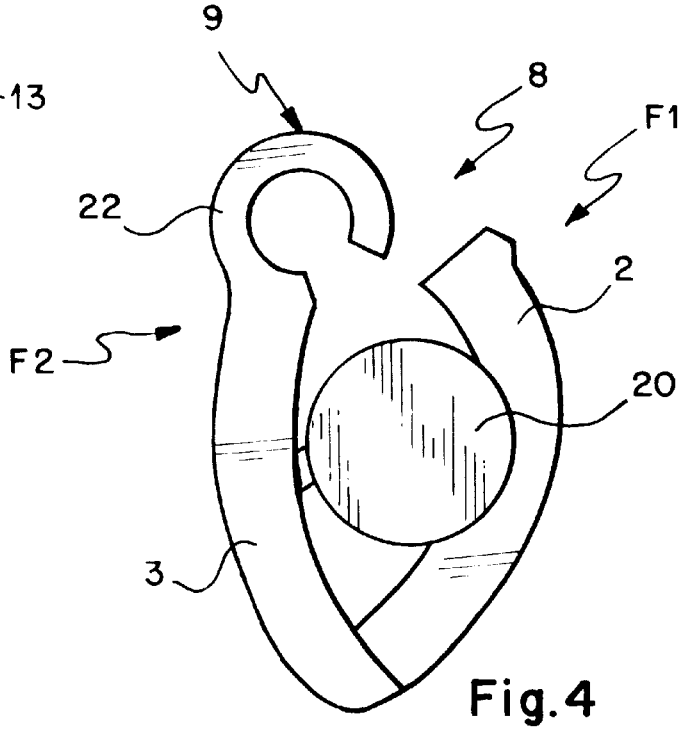
FIG. 4 is a view of the back of the device according to the invention, in the closed position, with the artide in woven or non-woven material held by the device.

Device 1, shown in particular in FIGS. 1 and 4, includes a first part (2) and a second part (3). The first part (2) and the second part (3) each possess a gripping device (4 and 5) at one of their ends (6 and 7), while their opposite ends (8 and 9) are free. These opposite ends (8 and 9) are located opposite to each other, and when the device is closed (FIGS. 1 and 4), there remains a space or a gap (10) between the ends (8 and 9). This gap allows the device to be placed onto a bar, such as the hanging rod in a wardrobe or the display racks used in department stores.

The device according to the invention also includes a third part (11) which connects the first part (2) and the second part (3). This third part (11) is flexible and elastic.

The first part (2) and the second part (3) are able to pivot in relation to each other, because of the flexibility and elasticity of the third part (11). It is preferable that the first part (2) and the second part (3) of the device (1) are of elliptical shape or that of a circular arc. As an example, as shown in FIGS. 1 and 4, the first and second parts (2 and 3) have the shape of an elliptical arc.

As can be seen from FIGS. 1 and 4, the device (1) in its rest position is such that the gripping device (4) of the first part (2) the gripping device (5) of the second part (3) are located opposite to each other and are engaged with each other, gripping the woven or non-woven material. In the active (or open) position, the gripping device (4) of the first part (2) and the gripping device (5) of the second part (3) are disengaged, the meshing parts being moved apart from each other. The woven or non-woven material is then released and no longer held.

The first part and the second part can be made in the form of hollow or solid tubing, in a plastic material for example.

According to the invention, the gripping device (4) of the first part (2) includes teeth (12) separated by serrations (13), and the gripping device (5) of the second part (3) includes teeth (14) separated by serrations (15). The teeth (12) of the first part (2) engage with the serrations (15) of the second part (3) and the teeth (14) of the second part (3) engage with the serrations (13) of the first part (2). The device (1) of the invention is then in its rest position, meaning that no external action is being applied to it.

As can be seen in FIGS. 1 and 4, the device is such that the first and second parts are circular arcs located opposite to each other in such a manner that the general shape of the device is oval.

The third part (11) is a circular arc, the centre (C) of which is located alongside the gripping devices (4 and 5). By exerting pressure on the first part (2) and on the second part (3), at the opposite ends (8 and 9) to the said gripping devices (4 and 5), one effects the disengagement of the gripping device (4) of the first part (2) and the gripping device (5) of the second part (3).

It is preferable that the first part (2) and the second part (3) should include, at the opposite ends (8 and 9) to their grhpping devices (4 and 5), serrations (16 and 17) at the outside edges (18 and 19). These serrations (16 and 17) enable the said ends (a and 9) to be moved toward each other in order to disengage the gripping device (4) of the first part (2) from the gripping device (5) of the second part (3).

According to a preferred implementation of the invention, the device also includes a plate (20), secured to the device by any suitable means. this plate being printed upon and bearing information such as the make of the clipped article. As an example, this plate can be a disk in printable polypropylene, secured onto a tab (21) or a tie on the first part.

The device according to the invention is also such that it includes, at the end opposite to the gripping part, a hook which enables the device to be placed onto a bar, such as the display racks normally used in department stores.

The device according to the invention is made from a resiliently flexible material, such as a plastic material like polyvinyl chloride or polyvinyl acetate.

The operation of the device is as follows:

When it is in the open position, there exists a space between the gripping devices (4 and 5). The third part (11) is deformed. This open position is achieved when one presses on the end (8) of the first part (2) and on the end (9) of the second part (3), in accordance with arrows F1 and F2.

The textile article is then placed between the gripping devices (4 and 5). Gripping device (5) is then allowed to move toward gripping device (4). This motion occurs when the ends (8 and 9) are released, and through the elasticity of the third part (11), which returns to its initial shape.

The resiliency of the device according to the invention is selected so that it has sufficient elasticity for the operations described above and in this application; that is, separating gripping devices (4 and 5) manually, from the closed position to the open position, and allowing such gripping devices to return to their closed position and retain the textile article therebetween.

When gripping device (5) engages with gripping device (4), the teeth (12 and 13) penetrate slightly into the woven or non-woven material, and grip the latter so that it is held between the teeth (12 and 13).

The plate (20) can bear printing indicating the size of the article, its nature, its make, or any other practical or advertising information.

When it is desired to release the article or articles held, the second part (3) is pivoted in relation to the first part (2) by pressing on the ends (8 and 9) of parts 2 and 3.

What is claimed is:

1. A clip for a textile article, the clip comprising:

first and second, arcuate members, the members having respective concave and convex sides, the concave sides opposing each other, the convex sides facing generally outwardly to define a perimeter of the clip, the arcuate members terminating in first and second opposing ends, the first opposing ends having gripping devices thereon;

a resiliently flexible part extending between the arcuate members, the part having opposite ends connected to respective, medial locations on the arcuate members, the part biasing the gripping devices against each other and biasing the second ends apart from each other;

wherein the second ends of the arcuate members are oriented generally toward each other to give the perimeter of the clip a substantially lozenge-like shape unlikely to get caught on adjacent textile articles.

2. The clip of claim 1, wherein one of the second ends terminates in a hook, the hook being generally oriented toward the other of the second ends to maintain the substantially lozenge-like shape of the perimeter of the clip.

3. The clip of claim 2, wherein a plate is secured to one of the arcuate members and oriented to extend in substantially coplanar relation to both of the arcuate members.

4. The clip of claim, wherein each of the second ends includes serrated portions on the convex sides of the arcuate members to facilitate manual engagement of the second ends.

5. The clip of claim 1, wherein the gripping devices comprise respective first and second surfaces having teeth extending therefrom, the first surface extending between the concave and the convex sides of the first arcuate member, the second surface defined on the concave side of the second arcuate member at a location to oppose the first surface to form an interengaging set of opposing teeth, and wherein the lozenge-like shape has an apex at the opposing first ends, the opposing surfaces extending to one side of the apex, whereby the second surface defined on the concave side opposes forces generally exerted substantially along the apex on the textile article being held by the opposing teeth, said forces being encountered from the clip and textile article tumbling in a dryer or being yanked by a customer from a merchandise rack.

6. A clip for socks comprising:

first and second, arcuate members, the members having respective concave and convex sides, the concave sides opposing each other, the convex sides facing generally outwardly to define a perimeter of the clip, the arcuate members terminating in first opposing ends having gripping devices thereon and second opposing ends;

a resiliently flexible part extending between the arcuate members, the part having opposite ends connected to respective, medial locations on the arcuate members, the part biasing the gripping devices against each other and biasing the second ends apart from each other;

wherein the second ends of the arcuate members are oriented generally toward each other to give the perimeter of the clip a substantially lozenge-like shape unlikely to get caught on adjacent textile articles;

wherein one of the second ends terminates in a hook generally oriented toward the other of the second ends to maintain the substantially lozenge-like shape of the perimeter of the clip;

wherein each of the second ends includes serrated portions on the convex sides of the arcuate members to facilitate manual engagement of the second ends;

wherein the gripping devices comprise respective first and second surfaces having teeth extending therefrom, the first surface extending between the concave and the convex sides of the first arcuate member, the second surface defined on the concave side of the second arcuate member at a location to oppose the first surface to form an interengaging set of opposing teeth, and wherein the lozenge-like shape has an apex at the opposing first ends, the opposing surfaces extending to one side of the apex, the second surface defined on the concave side thereby opposing forces encoubtered from the clip and textile article tumbling in a dryer or being yanked by a customer from a merchandise rack, said forces being generally exerted substantially along the apex on the textile article being held by the opposing teeth.

* * * * *